United States Patent [19]

Kawasaki

[11] Patent Number: 4,814,561

[45] Date of Patent: Mar. 21, 1989

[54] ELASTIC MEMBER FOR SUPPORTING A KEY TOP IN A PUSH BUTTON SWITCH CONSTRUCTION

[75] Inventor: Hiroshi Kawasaki, Nara, Japan

[73] Assignee: Sharp Kabushiki Kaisha, Osaka, Japan

[21] Appl. No.: 548,241

[22] Filed: Nov. 3, 1983

[30] Foreign Application Priority Data

Nov. 11, 1982 [JP] Japan ..... 57-198416

[51] Int. Cl.[4] ..... H01H 13/70

[52] U.S. Cl. ..... 200/517; 200/5 A

[58] Field of Search ..... 200/159 B, 5 A

[56] References Cited

U.S. PATENT DOCUMENTS 4,315,114 2/1982 Monti ..... 200/5 A
4,390,765 6/1983 Sado ..... 200/159 B
4,491,702 1/1985 Kato ..... 200/159 B

FOREIGN PATENT DOCUMENTS 3142367 5/1983 Fed. Rep. of Germany ... 200/159 B

*Primary Examiner*—John W. Shepperd

*Attorney, Agent, or Firm*—Birch, Stewart, Kolasch & Birch

[57] ABSTRACT

An elastic key top construction for supporting a key top comprising a key top push or support section on which the key top is mounted, a projection disposed below the key top support section, a first movable wall integral with the key top support section and the projection for connecting the key top support section to the projection while allowing relative movement to each, a second movable wall integral with the key top support section, the second movable wall being connected to a installment support member of the key top construction so as to allow up/down movement of the key top support section in respect to the base member.

3 Claims, 4 Drawing Sheets

FIG.5
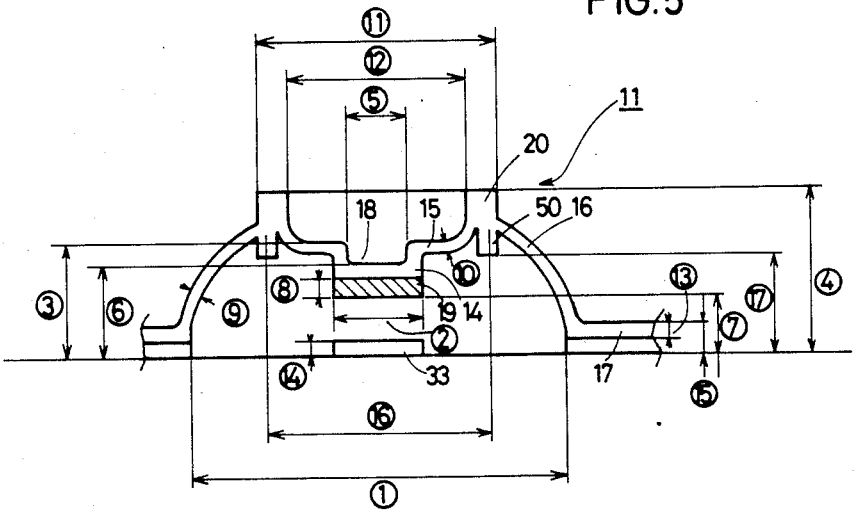
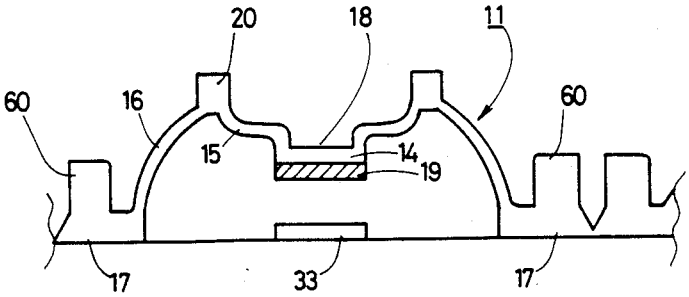
FIG.6

ELASTIC MEMBER FOR SUPPORTING A KEY TOP IN A PUSH BUTTON SWITCH CONSTRUCTION

BACKGROUND OF THE INVENTION

The present invention relates to an improved key-top holder in a push button switch, and more particularly, to an improved key-top holder made of an elastic or a resilient material for a push button switch, applicapable to a small-size apparatus such as a desk-top calculator, an electronic cash register or an electronic calculator.

Conventionally, electrical switches made of a conductive rubber (an elastomer) are known as disclosed in U.S. Pat. No. 3,699,294 issued on Oct. 17, 1972, entitled "KEYBOARD, DIGITAL CODING, SWITCH FOR DIGITAL LOGIC, AND LOW POWER DETECTOR SWITCHES". Also, a push button comprising a resilient body having a snaping and tilting wall of a mesa shape is known as disclosed in U.S. Pat. No. 3,932,722 issued on Jan. 13, 1976, entitled "PUSH BUTTON BODY FOR A PUSUBUTTON SWITCH PROVIDING SNAP-ACTION OF THE SWITCH".

For example, a push button as shown in FIGS. 1(*a*)–1(*c*) for a push button switch has been developed by the present applicant. A push button 1 for a push button switch has a projection 4 at the center part of the push button 1. A conductive rubber 9 is provided on the projection 4 so as to close electrical contacts on a base (not shown). An installment support member 7 is mounted on the base. When the push element or key top support section 10 of the push button 1 is depressed via a key-top (not shown), the projection 4 is moved downward so as to force the conductive rubber 9 to be engaged with the electrical contacts on the base.

According to the movement of the projection 4, the shape of the thin walls 5 and 6, supporting the projection 4, are changed. As the shape of the push button 1 changes successively, as shown in FIGS. 1(*a*)–1(*c*), the shape of the thin walls 5 and 6 are also changed as shown and are returned to their original shape (position) when the depressing force is released.

In the push button construction, as shown in FIGS. 1(*a*)–1(*c*), if many switching movements are repeated, for example thousands of times, the push button switch 1, made of an elastic rubber, will crack. For example, sections a and b of FIG. 1(*a*) may crack. This is because, although the length of the wall 5 is short, the distance through which the wall 5 moves is considerably longer and the wall is thus subject to snapping at sections a and b.

SUMMARY OF THE INVENTION

An object of the present invention is to provide an improved elastic member for supporting a key top in a push button switch construction.

Another object of the present invention is to provide an improved durable push button made of an elastic rubber.

Still another object of the present invention is to provide a push button for a push button switch applicapable to a small electronic apparatus, wherein the key stroke is long and the switching space is narrow.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

According to the present invention, an elastic key top support member supports a key top. A key top suport section, to which the key top is mounted provides, a projection disposed below the key top support section. A first movable wall integral with the key top support section and the projection connects the key top support section to the projection while allowing relative movement to each. A second movable wall is integral with the key top support section, the second movable wall being connected via an installment support to a base member of the key top construction, so as to allow up/down movement of the key top support section with respect to the base member.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 2(*d*) is a sectional view of a preferred embodiment of a push button construction of the present invention, wherein the push button is made of an insulated silicone rubber;

FIGS. 5 and 6 are sectional views of still other embodiments of the present invention.

DETAILED DESCRIPTION OF THE INVENTION

Figure 1A:
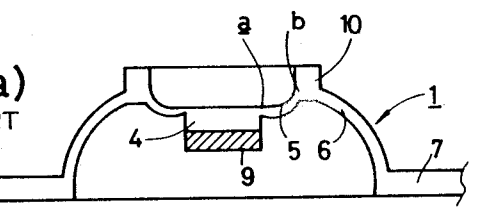
FIG.1(a) PRIOR ART
FIGS. 1(*a*)–1(*c*) are sectional views of a push button of the prior art.
Figure 1B:
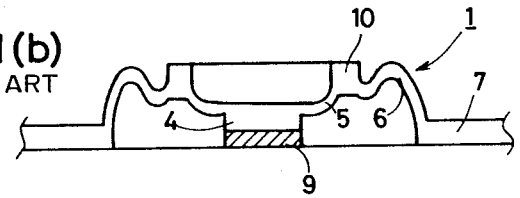
FIG.1(b) PRIOR ART
Figure 1C:
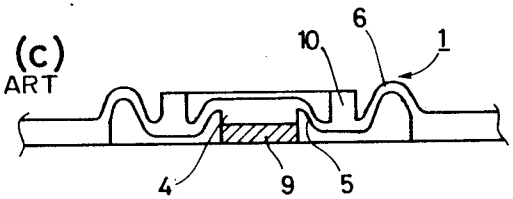
FIG.1(c) PRIOR ART
Figure 2A:
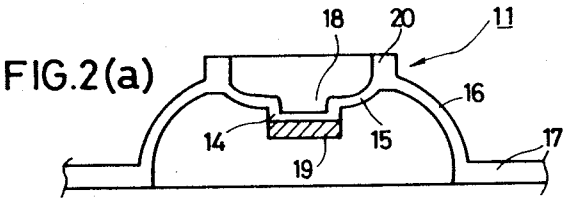
FIGS. 2(*a*)–2(*c*) are sectional views of a push button for a push button switch according to an embodiment of the present invention.
Figure 2B:
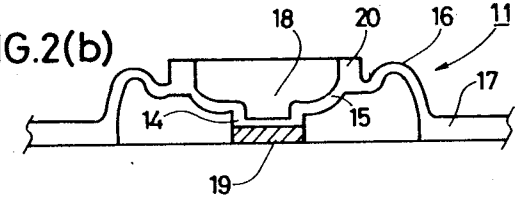
Figure 2C:
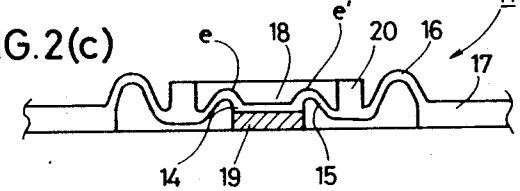
Figure 2D:
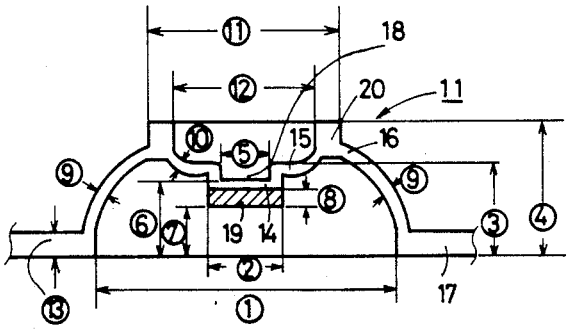

FIGS. 2(*a*)–2(*c*) are sectional views of a push button for a push button switch according to an embodiment of the present invention. A push button 11 for a push button switch is made of an elastic rubber including an insulated silicone rubber or the like. The push button 11 is made of a medial thin wall 15 and lateral thin wall 16 integrally joined by, a push or key top support section 20, a bridge or projection 14 forming a concave section 18, and an installment member 17. The shape of the push button 11 elastically varies when a depressing force is applied to the push section 20. The push button 11 has the projection 14 at the center part of the push button 11 to confront the electrical contacts, for example, comb-type contact, mounted on a base. A conductive member 19, such as a conductive sheet, comprising a rubber, metal, or carbon, is attached to the projection 14. The projection 14 communicates or joins with one end of the movable thin wall 15 forming the bridge defining concave section 18, and the other end of the movable thin wall 15 communicates with the movable thin wall 16 via the push section 20. When the push section 20 of the push button 11 is depressed through a key-top, the projection 14 is moved downwardly so as to contact the conductive member 19 with the contacts on the base.

Further, the shape of the movable thin walls 15 and 16 varies as shown in FIGS. 2(*a*)–2(*c*) according to the up/down action of the projection 14.

The moving thin wall 16 is connected with the moving thin wall 15 via the push section 20 and is bent relative to the installment member 17. When the downward depression force is applied to the push section 20, the moving thin wall 16 first bends till the conductive member 19 comes into contact with the contacts formed on the base. As the downward depression force is continuously applied to the push section 20, the moving thin wall 15 bends to absorb the additional depression force.

A concave section 18 is provided on the upper face of the projection 14 so as to dampen the force which is applied to the moving thin wall 15. By providing the concave section 18, the snapping movement of the button is smoothly conducted because the bent portion of the thin wall 15 functions further to absorb the tension force or the depression force applied to the button. If the push button 11 is depressed completely, as shown in FIG. 2(*c*), the load which is applied to the moving thin wall 15 is reduced remarkably because the distance between sections e and e′ tends to extend outwardly. Accordingly, a crevice of the elastic rubber at the moving thin wall 15 caused by the repetitive snap movements of the push button can be minimized. For example, the push button of the present invention can withstand shock of the repetitive snap movements of 700 thousand or more.

FIG. 2(*d*) shows a preferred example of a push button construction of the present invention, wherein the push button 11 is made of an insulated silicone rubber (Flexibility about 42° ), and has the size as shown in the following Table I.

TABLE I

| | | |
|---|---|---|
| ① | (DIAMETER) | about 12–12.5 mm |
| ② | (DIAMETER) | about 3.0 mm |
| ③ | (HEIGHT) | about 3.8 mm |
| ④ | (HEIGHT) | about 5.5 mm |
| ⑤ | (DIAMETER) | about 2.0 mm |
| ⑥ | (HEIGHT) | about 3.0 mm |
| ⑦ | (HEIGHT) | about 1.85–2.0 mm |
| ⑧ | (THINKNESS) | about 0.55 mm |
| ⑨ | (THINKNESS) | about 0.4 mm |
| ⑩ | (THINKNESS) | about 0.4 mm |
| ⑪ | (WIDTH) | about 8.0 mm |
| ⑫ | (WIDTH) | about 6.0 mm |
| ⑬ | (THINKNESS) | about 0.5 mm |

The size of the push button 11 is not limited to the above example, and the size should vary in response to the quality of the material for making the push button 11. Also, the thinkness of the moving thin walls 15 and 16 is not necessarily fixed. It may be gradually increased or decreased from one end to the other. As can be determined from the table I the depth of the concave section 18 is about twice the thickness of the wall 15.

Figure 3:
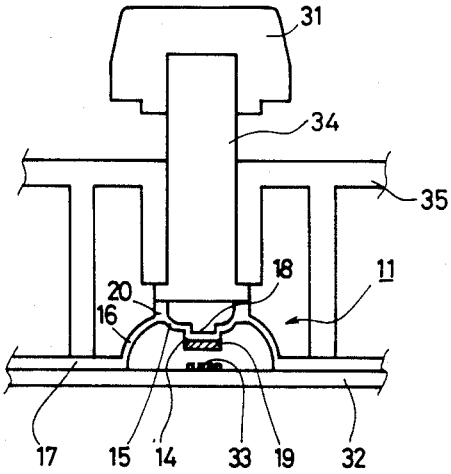
FIG. 3 is a sectional view of a push button switch using the push button of FIGS. 2(*a*)–2(*c*)

FIG. 3 shows a sectional view of the push button switch using the push button of FIGS. 2(*a*)–2(*c*). In FIG. 3, the configuration includes a base 34 having contacts 33, such as comb-type contacts, a key top 31, 34 a stem 32, and a support member 35. When the keytop 31 is depressed, the depressed-force is applied to the push section 20 through the stem 32, and the shape of the push button 11 is changed as shown in FIGS. 2(*a*-)–2(*c*).

As the push button 11 of the above embodiment is made of an insulated rubber, for example, an insulated silicone rubber, the conductive member 19 on the projection 14 is made of a conductive material, for example, a conductive sheet comprising a rubber. But, the push button 11 may be made of a conductive material as a whole, so that the conductive member 19 can be eliminated.

Figure 4:
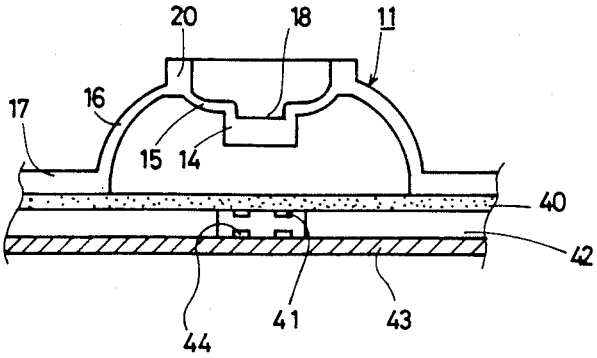
FIG. 4 is a sectional view of a push button according to another embodiment of the present invention.

FIG. 4 is a sectional view of a push button switch using the push button according to another embodiment of the present invention.

There are additionaly provided in FIG. 4 a flexible base 40, contacts 41, a spacer 42, a support base 43, and fixed contacts 44. The contacts 41 on the flexible base 40 contact the fixed contacts 44 on the support base 43 in response to the depression of the projection 14. The spacer 42 serves to separete the flexible base 40 from the support base 43 in the absence of the depression of the projection 14. The conductive member 19 is not required in the embodiment of FIG. 4.

FIGS. 5 and 6 show sectional views of still other embodiments of the present invention.

With reference to FIG. 5, in addition to the elements of FIG. 2(*a*), a circular shaped extrusion 50 is provided at the connecting point between the movable thin walls 15 and 16. The extrusion 50 functions to prevent the connecting point between the movable thin walls 15 and 16 from undesirable over-movement downward. If the push button 11 is made of an insulated silicone rubber (Flexibility about 42°), the size of the push button 11 of FIG. 5 is shown in Table II. Like elements corresponding to those of Table I are omitted for the purpose of simplicity.

TABLE II

| | | |
|---|---|---|
| ⑭ | (THINKNESS) | about 0.5 mm |
| ⑮ | (THINKNESS) | about 1.0 mm |
| ⑯ | (DIAMETER) | about 7.5 mm |
| ⑰ | (HEIGHT) | about 3.3 mm |

With reference to FIG. 6, in addition to the elements of the FIG. 2(*a*), extrusions 60 are provided on the installment member 17. The extrusions 60 serve to supplement the strength of the installment member 17.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A push button configuration comprising a key top support section, a projection disposed below said key top support section, a first movable wall which connects said key top support section to said projection while allowing relative movement thereto, and a second movable wall for connecting said key top support section to a base member via an installment member, said installment member being provided with extrusion elements which strengthen said installment member said projection having an upper face portion which defines a concave section having a depth about twice the thickness of said first movable wall and a diameter smaller than a diameter of said projection.

2. The push button configuration of claim 1, further including a conductive member on a bottom face portion of said projection.

3. The push button configuration of claim 1, wherein said integral projection, first and second movable walls, key top support section and installment member including said extrusions are made of elastic rubber.

* * * * *